US006016585A

United States Patent [19]

Allen

[11] Patent Number: 6,016,585

[45] Date of Patent: Jan. 25, 2000

[54] ROTARY SLUDGE REMOVER

[76] Inventor: Henry W. Allen, 12014 Lake Lery Ave., Baton Rouge, La. 70816

[21] Appl. No.: 09/013,529

[22] Filed: Jan. 26, 1998

Related U.S. Application Data

[60] Provisional application No. 60/036,458, Jan. 27, 1997.

[51] Int. Cl.[7] ..... C10B 43/04

[52] U.S. Cl. ..... 15/93.1; 172/21; 404/124; 405/258

[58] Field of Search ..... 15/93.1; 172/21, 172/22; 404/90, 121, 124; 405/258, 303

[56] References Cited

U.S. PATENT DOCUMENTS

| | | | |
|---|---|---|---|
| 2,581,183 | 1/1952 | Galamb | 15/93.1 |
| 3,586,109 | 6/1971 | Eversole | 172/22 |
| 3,958,294 | 5/1976 | Thompson | 15/93.1 |
| 4,675,052 | 6/1987 | Badinier | 15/93.1 |
| 4,858,697 | 8/1989 | Sherblom | 172/21 |
| 5,014,791 | 5/1991 | Kure | 172/21 |
| 5,138,741 | 8/1992 | Allen . | |
| 5,269,041 | 12/1993 | Allen . | |
| 5,335,395 | 8/1994 | Allen . | |
| 5,632,342 | 5/1997 | Knoblich | 172/21 |

*Primary Examiner*—Randall E. Chin
*Attorney, Agent, or Firm*—David L. Ray

[57] ABSTRACT

A rotary sludge cutter for digging up sludge to be removed by pumps on a remote controlled sludge removal apparatus. The invention includes a plurality of cutting spikes mounted on a cylindrical, rotating drum connected to a sludge removal apparatus. The spikes make rotating contact with the sludge and break and grind the sludge into small particles which can be pumped to a remote location by the sludge removal apparatus.

22 Claims, 5 Drawing Sheets

ROTARY SLUDGE REMOVER

CROSS-REFERENCE TO RELATED APPLICATIONS

This application claims the benefit of the filing date and priority of co-pending provisional application Ser. No. 60/036,458 filed Jan. 27, 1997.

BACKGROUND OF THE INVENTION

1. Field of the Invention

The invention relates to remote controlled sludge removal apparatus. In particular, the invention relates to devices for breaking sludge loose from sludge deposits to enable the sludge to be pumped from the sludge storage area by a remote controlled sludge removal apparatus.

2. Description of the Related Art

My U.S. Pat. Nos. 5,335,395; 5,269,041; and 5,138,741 disclose sludge removal apparatus having tracks thereon for propelling the sludge removal apparatus over the area being cleaned by the apparatus. In my above mentioned U.S. Patents, sludge located at the bottom of a sludge storage area was dug up by an auger connected to the sludge removal apparatus.

It is an object of the present invention to provide an improved apparatus for digging up sludge from the bottom of a sludge storage area.

SUMMARY OF THE INVENTION

In accordance with the present invention there is provided a rotary sludge cutter for digging up sludge to be removed by pumps on a remote controlled sludge removal apparatus. The invention includes a plurality of cutting spikes mounted on a cylindrical, rotating drum connected to a sludge removal apparatus. The spikes make rotating contact with the sludge and break and grind the sludge into small particles which can be pumped to a remote location by the sludge removal apparatus.

DESCRIPTION OF THE PREFERRED EMBODIMENTS

The remote controlled sludge removal apparatus for which the rotary sludge remover of the invention is particularly useful is disclosed in my U.S. Pat. Nos. 5,335,395; 5,269,041; and 5,138,741, which are hereby incorporated by reference.

Figure 1:
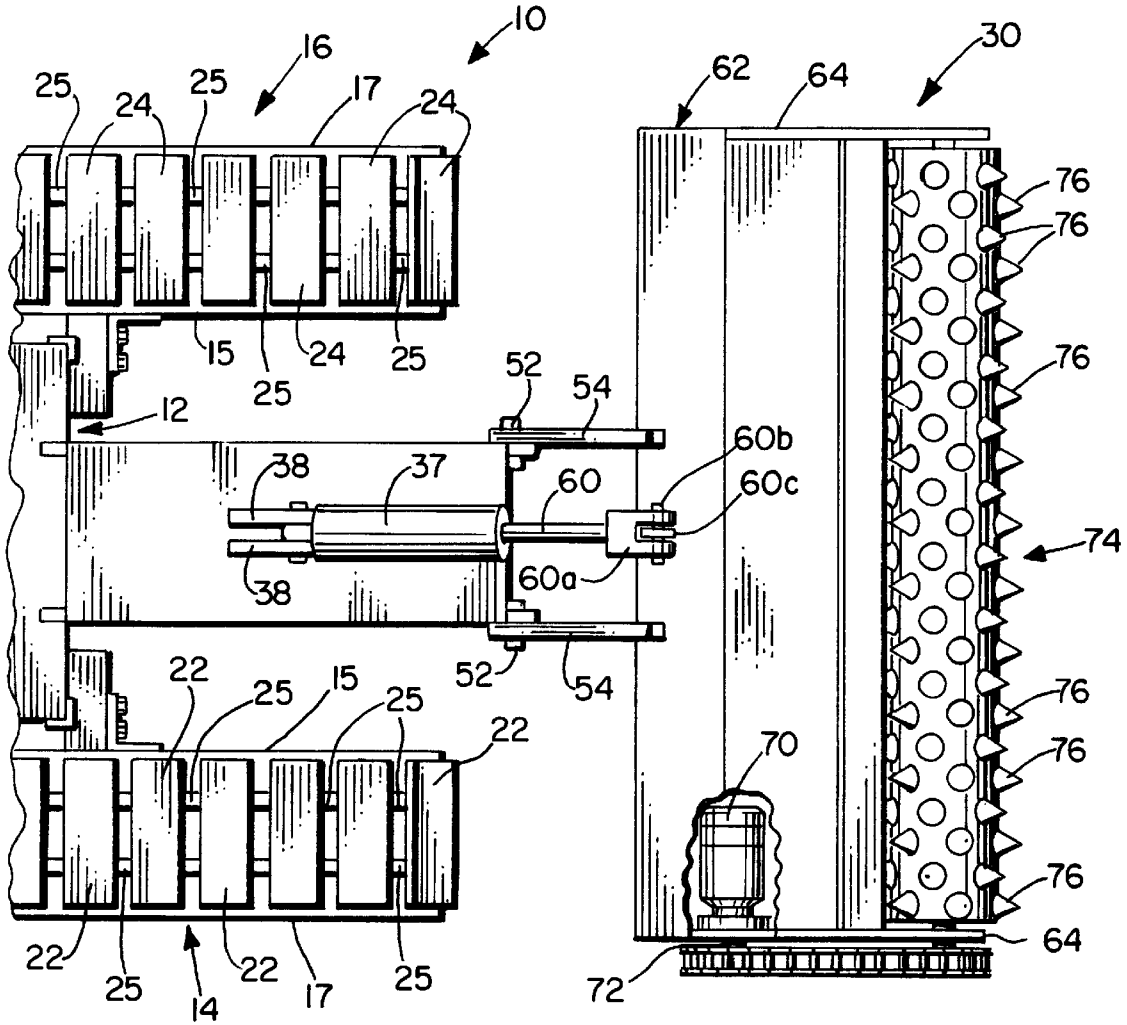
FIG. 1 is a partly cut away top schematic view of a portion of a sludge removal apparatus having the rotary sludge remover of the invention connected thereto.
Figure 2:
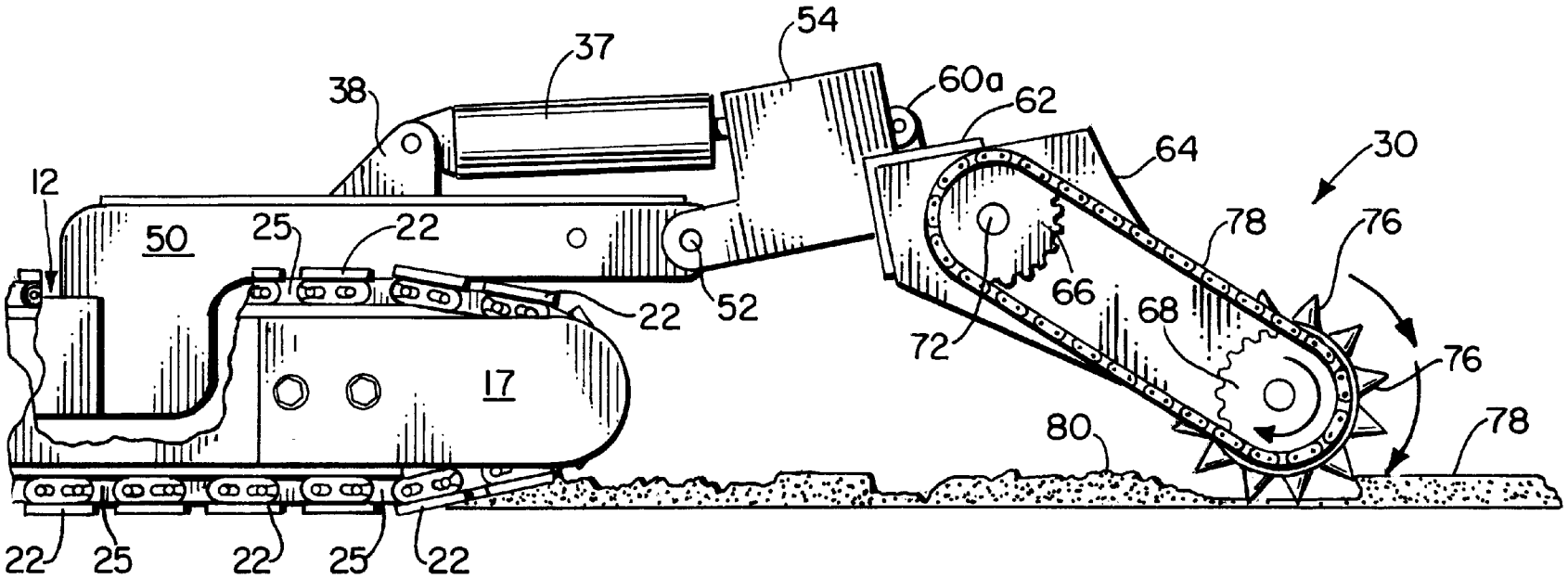
FIG. 2 is a partly cut away side elevational schematic view of the sludge removal apparatus of FIG. 1.

Referring now to the drawings, and in particularly to FIGS. 1 and 2, the sludge removal apparatus of U.S. Pat. Nos. 5,335,395; 5,269,041; and 5,138,741 can be seen to be generally indicated by the numeral 10. By sludge is meant the viscous residue of hydrocarbons such as crude oil, such as sewerage digester settlement, sludge contained in sludge pits, radioactive nuclear waste deposited on the bottom of a radioactive nuclear waste storage area or any other type of sludge which is desired to be removed from a sludge containment area.

The sludge removal apparatus 10 disclosed in U.S. Pat. Nos. 5,335,395; 5,269,041; and 5,138,741, includes a platform generally indicated by the numeral 12 which is connected to two track assemblies generally indicated by the numerals 14 and 16 having inside track assembly walls 15 and outside track assembly walls 17, respectively. Mounted on platform 12 is a pump (not shown) having a discharge (not shown) and a bottom intake (not shown) connected thereto for pumping slurries of sludge from the sludge containment area to a desired storage area.

Connected to each of the track assemblies 14 and 16 are tracks 22 and 24 respectively. Tracks 22 and 24 are driven at the rear ends (not shown) by motors (not shown) respectively. Tracks 22 and 24 are connected by chain links 25.

The rotary sludge remover of the invention is generally indicated by the numeral 30 and replaces the two auger assemblies that were located at the front of each track assembly 14 and 16 of the sludge removal apparatus 10 which is disclosed U.S. Pat. Nos. 5,335,395; 5,269,041; and 5,138,741. Rotary sludge remover 30 shown in FIGS. 1 and 2, and rotary sludge remover 130 shown in FIGS. 3–5, grind and cut sludge 78 into small particles 80 and force the sludge to the area between the track assemblies 14 and 16 and beneath platform 12 for intake and removal by a pump (not shown) on platform 12 of sludge removal device 10.

As can be seen in FIG. 1 and 2, rotary sludge remover 30 is connected to platform 12 by support assembly 50 which is rigidly connected to platform 12. Rotary sludge remover 30 has two plates 54—54 rigidly connected thereto which are pivotally connected to support assembly 50 by pins 52—52 and can rotate upwardly and downwardly thereon. Hydraulic cylinder 37 is connected to piston supports 38—38 which are rigidly connected to support assembly 50.

Hydraulic cylinder 37 has piston 60 extending therefrom. Piston 60 has clevis **60*a* connected thereto. Clevis 60*a* is connected to the carriage assembly generally indicated by the numeral 62 by pin 60*b* which extends through a bracket 60*c* rigidly connected to carriage 62. Retracting piston 60 into hydraulic cylinder 37 causes rotary sludge remover 30 to be lifted upward away from sludge 78, and extending piston 60 outward from hydraulic cylinder 37 causes rotary sludge remover 30 to contact sludge 78 as shown in FIG. 2**.

Carriage 62 has two side plates 64 extending therefrom. Side plate 64 supports sprockets 66 and 68 which turn in the direction indicated by the arrows in FIG. 1 when motor 70 is actuated.

Motor 70 is connected to sprocket 66 by drive shaft 72. Sprocket 68 is connected to the cylindrical drum generally indicated by the numeral 74. Cylindrical drum 74 has a plurality of high strength carbide spikes or tips 76 thereon which are generally conical in shape. Carbide spikes or tips 76 are aligned closely together and equally spaced apart over the entire surface of cylinder 74. Spikes or tips 76 may be made of a ¾ inch diameter high strength metal rod, 1 and ½ inch in length, sharpened to a pencil point at the exterior end and welded to drum 74. Chain 76 links sprocket 66 to 68. Thus when motor 70 is actuated, sprocket 66 turns and drives chain 78 to turn sprocket 68 in the direction as indicated by the arrow on sprocket 68. Tips or spikes 76 contact sludge layer 78 as shown in FIG. 2 and grind and cut the sludge 78 into small particles 80 which can be slurried and pumped from the sludge containment area in which the sludge is found by sludge removal device 10.

Figure 3:
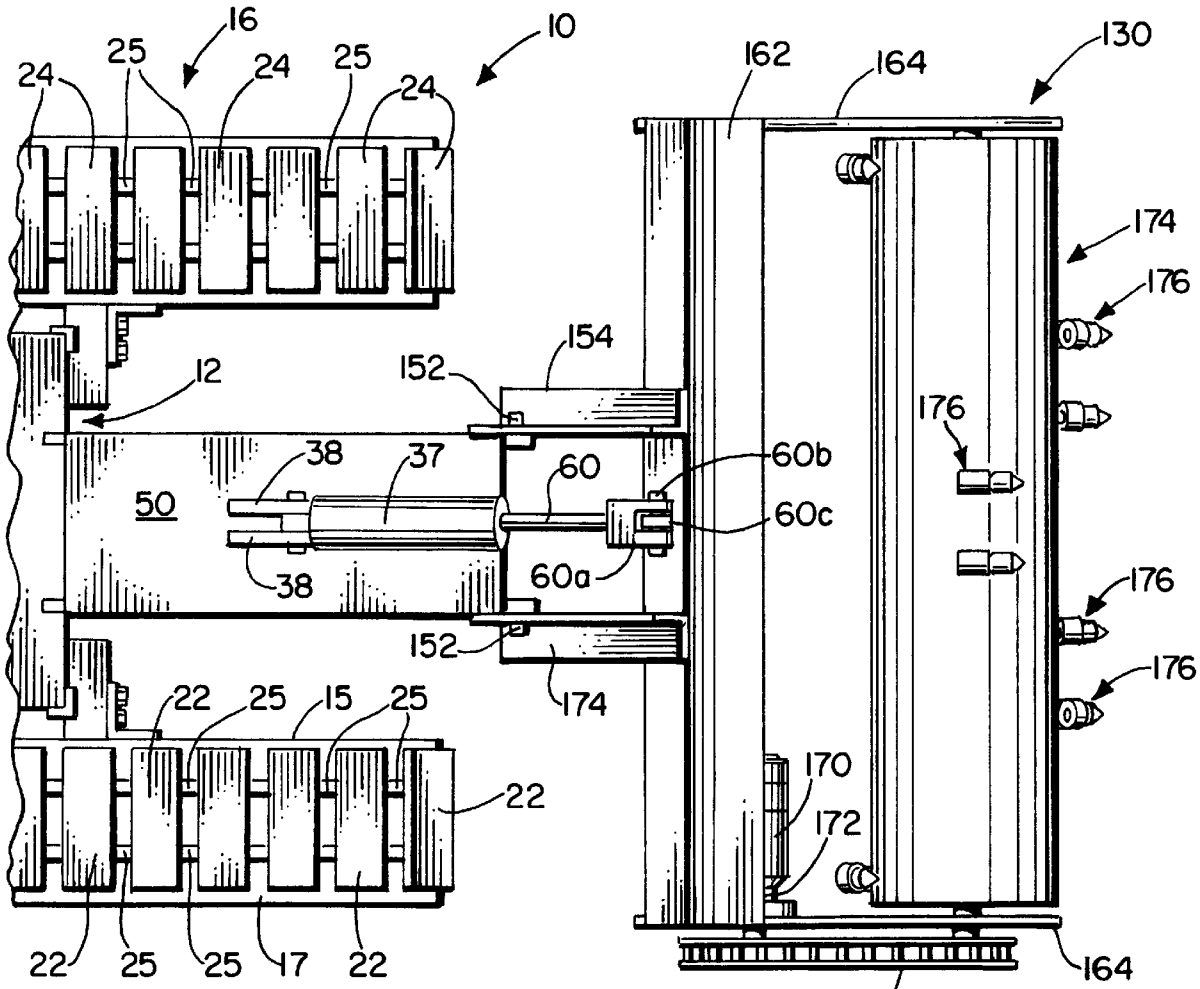
FIG. 3 is a partly cut away top schematic view of a portion of a sludge removal apparatus having a second embodiment of the rotary sludge remover of the invention connected thereto.
Figure 4:
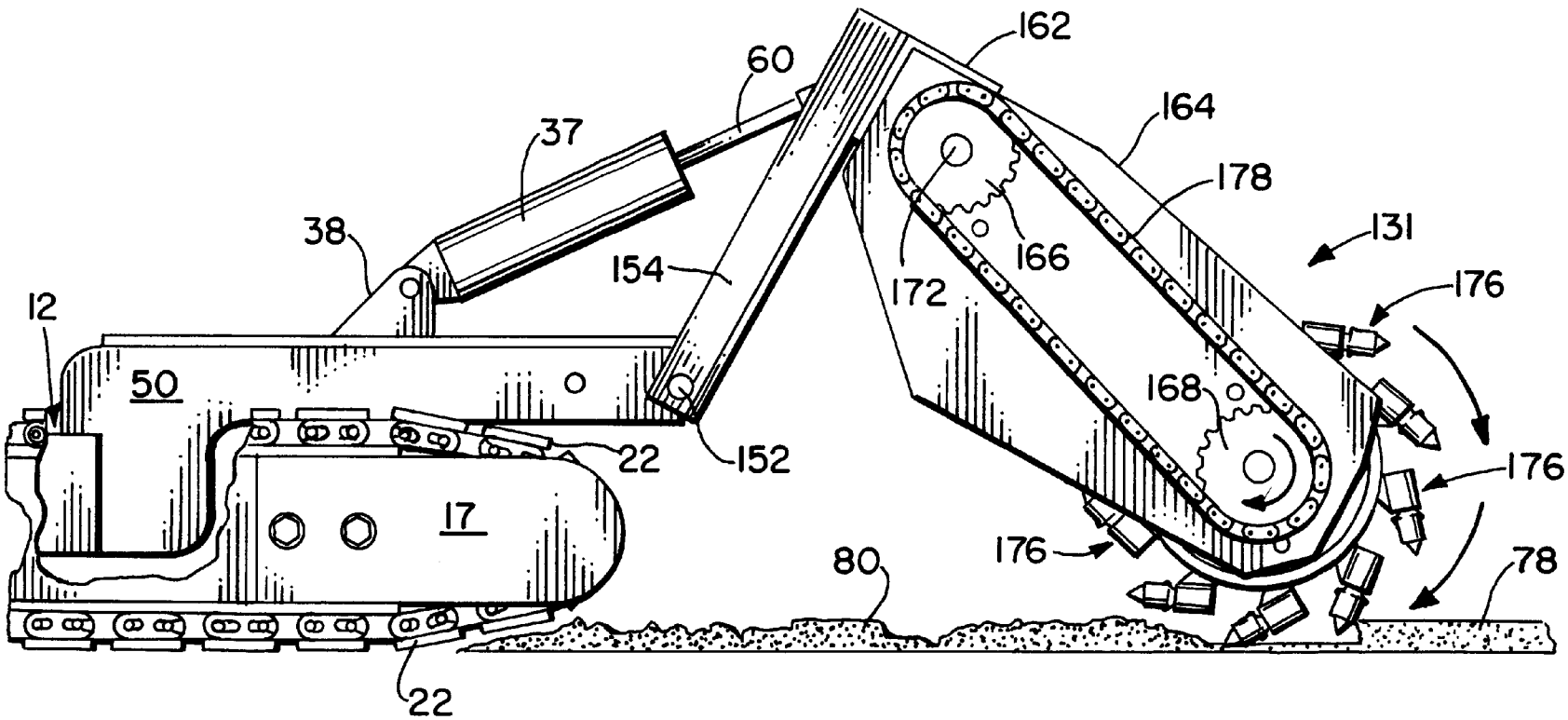
FIG. 4 is a partly cut away side elevational view of the sludge removal apparatus of FIG. 3.
Figure 5:
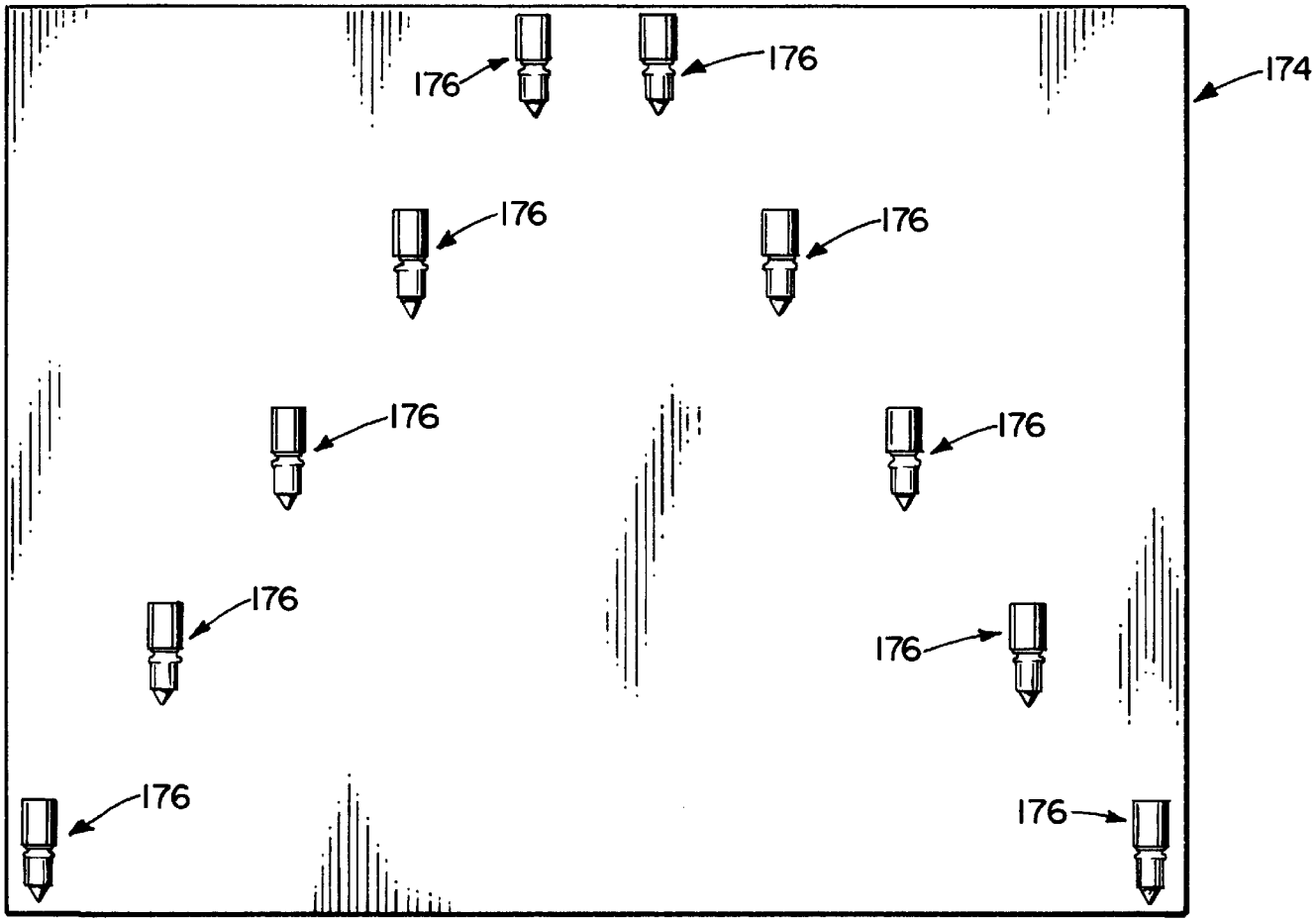
FIG. 5 is a schematic view of the entire surface of the drum of the second embodiment spread out in a plane to illustrate the pattern of spikes 17.

In FIGS. 3, 4, and 5 is shown a second embodiment of the invention. All of the components of the sludge removal device 10 and hydraulic cylinder 37, piston supports 38—38, support assembly 50, piston 60, clevis 60*a*, pin 60*b*, and bracket 60*c* are the same as the first embodiment of the invention shown in FIGS. 1 and 2 and operate in the same manner as the embodiment shown in FIGS. 1 and 2 as explained above. In the second embodiment of the invention, plates 54—54 of the first embodiment have been replaced with plates 154—154, pins 52—52 of the first embodiment have been replaced with pins 152—152, carriage 62 of the first embodiment has been replaced with carriage 162, side plates 64—64 of the first embodiment have been replaced with side plates 164—164, sprocket 66 of the first embodiment has been replaced with sprocket 166, sprocket 68 of the first embodiment has been replaced with sprocket 168, motor 70 of the first embodiment has been replaced with motor 170, and drive shaft 72 of the first embodiment has been replaced with drive shaft 172. The second embodiment of the invention operates in the same manner as the first embodiment of the invention as explained above and is generally indicated by the numeral 130. Rotary sludge remover 130 has a cylindrical drum 174 with a plurality of carbide tips or spikes 176 thereon which are arranged in a V-shaped pattern as shown in FIG. 5. Preferably the angle between the two V-shaped rows of carbide spikes or tips ranges from 20 to 40 degrees.

FIG. 5 shows the entire surface of cylindrical drum 174 spread out in one plane. The carbide spikes or tips 176 are angled backwardly as shown in FIG. 4 to contact and comminute sludge 78 into small particles 80.

Although the preferred embodiments of the invention have been described in detail above, it should be understood that the invention is in no sense limited thereby, and its scope is to be determined by that of the following claims:

What is claimed is:

1. A rotary sludge cutting assembly for digging up sludge to be removed by pumps on a remote controlled sludge removal apparatus having a platform connected to two track assemblies, said track assemblies being adapted to propel said sludge removal apparatus over the area from which sludge is being removed, the rotary sludge cutting assembly comprising:

a. a support assembly rigidly connected to said platform, b. a rotary sludge remover assembly rotatably connected to said support assembly to enable said rotary sludge assembly to be raised from and lowered into contact with the surface of the area from which sludge is being removed, said rotary sludge remover assembly having a cylindrical, rotating drum, said cylindrical rotating drum having a plurality of cutting spikes mounted on the outer surface thereof for making rotating contact with said sludge to break and grind said sludge into small particles which can be pumped to a remote location by said sludge removal apparatus, said outer surface of said rotating drum being aligned parallel to the surface of the area from which said sludge is being removed.

2. The assembly of claim 1 wherein a hydraulic cylinder and piston assembly is connected to said support assembly and said rotary sludge remover assembly to raise and lower said rotary sludge remover assembly upward and downward.

3. The apparatus of claim 1 wherein said rotary sludge remover assembly has two parallel, spaced-apart side plates connected to a carriage assembly, said cylindrical, rotating drum being rotatably connected between said two side plates.

4. The apparatus of claim 3 wherein said carriage assembly is rotatably connected to said support assembly and to said hydraulic cylinder and piston assembly.

5. The apparatus of claim 4 wherein said carriage assembly has a motor connected thereto for rotating said cylindrical, rotating drum.

6. The apparatus of claim 5 wherein said motor has a drive shaft which is rigidly connected to a sprocket.

7. The apparatus of claim 6 wherein said cylindrical, rotating drum has a sprocket rigidly connected thereto.

8. The apparatus of claim 7 wherein said sprocket connected to said drum is rotatably connected to said sprocket connected to said drive shaft of said motor by a chain.

9. The apparatus of claim 1 wherein said cutting spikes are conical in shape.

10. The apparatus of claim 1 wherein said spikes are coated with carbide.

11. The apparatus of claim 1 wherein said cutting spikes are arranged in a V-shaped pattern on said cylindrical, rotating drum.

12. In a remote controlled sludge removal apparatus having a platform connected to two track assemblies and pumps for removing sludge, said track assemblies being adapted to propel said sludge removal apparatus over the area from which sludge is being removed, the improvement comprising:

a. a support assembly connected to said platform, b. a rotary sludge remover assembly rotatably connected to said support assembly to enable said rotary sludge assembly to be raised from and lowered into contact with the surface of the area from which sludge is being removed, said rotary sludge remover assembly having a cylindrical, rotating drum, said cylindrical rotating drum having a plurality of cutting spikes mounted on the outer surface thereof for making rotating contact with said sludge to break and grind said sludge into small particles which can be pumped to a remote location by said sludge removal apparatus, said outer surface of said rotating drum being aligned parallel to the surface of the area from which said sludge is being removed.

13. The assembly of claim 12 wherein a hydraulic cylinder and piston assembly is connected to said support assembly and said rotary sludge remover assembly to raise and lower said rotary sludge remover assembly upward and downward.

14. The apparatus of claim 12 wherein said rotary sludge remover assembly has two parallel, spaced-apart side plates connected to a carriage assembly, said cylindrical, rotating drum being rotatably connected between said two side plates.

15. The apparatus of claim 14 wherein said carriage assembly is rotatably connected to said support assembly and to said hydraulic cylinder and piston assembly.

16. The apparatus of claim 15 wherein said carriage assembly has a motor connected thereto for rotating said cylindrical, rotating drum.

17. The apparatus of claim 16 wherein said motor has a drive shaft which is rigidly connected to a sprocket.

18. The apparatus of claim 17 wherein said cylindrical, rotating drum has a sprocket rigidly connected thereto.

19. The apparatus of claim 18 wherein said sprocket connected to said drum is rotatably connected to said sprocket connected to said drive shaft of said motor by a chain.

20. The apparatus of claim 13 wherein said cutting spikes are conical in shape.

21. The apparatus of claim 13 wherein said spikes are coated with carbide.

22. The apparatus of claim 13 wherein said cutting spikes are arranged in a V-shaped pattern on said cylindrical, rotating drum.

* * * * *